US007764919B2

(12) United States Patent
Lim

(10) Patent No.: US 7,764,919 B2
(45) Date of Patent: Jul. 27, 2010

(54) IMAGE FORMING APPARATUS WITH A WASTE STORAGE CONTAINER

(75) Inventor: Young Taek Lim, Seoul (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 293 days.

(21) Appl. No.: 11/869,833

(22) Filed: Oct. 10, 2007

(65) Prior Publication Data

US 2008/0187378 A1 Aug. 7, 2008

(30) Foreign Application Priority Data

Feb. 6, 2007 (KR) ..... 10-2007-0012389

(51) Int. Cl.
*G03G 21/12* (2006.01)

(52) U.S. Cl. ..... 399/360

(58) Field of Classification Search ..... 399/35, 399/358–360

See application file for complete search history.

(56) References Cited

U.S. PATENT DOCUMENTS 6,266,511 B1 * 7/2001 Murakami et al. ..... 399/358

7,280,776 B2 * 10/2007 Cook et al. ..... 399/35

FOREIGN PATENT DOCUMENTS

JP 2002-229402 8/2002

* cited by examiner

*Primary Examiner*—Hoang Ngo
(74) *Attorney, Agent, or Firm*—Stanzione & Kim LLP

(57) ABSTRACT

An image forming apparatus including a compact waste toner storage device in which waste toner can be evenly stored. The image forming apparatus includes a waste toner tank to store the waste toner that is collected from a cleaning member to remove the residual waste toner on an image carrying body, and a vibration unit provided inside the waste toner tank to prevent the waste toner from accumulating unevenly. Because the vibration unit is provided inside the waste toner tank, the apparatus can be manufactured compactly. Also, because a coil spring and a stopper are used in the vibration unit, the vibration unit does not take up much space in the waste toner tank. Further, much more waste toner can be stored in the waste toner tank, despite having a same size as a conventional waste toner tank.

20 Claims, 8 Drawing Sheets

IMAGE FORMING APPARATUS WITH A WASTE STORAGE CONTAINER

CROSS-REFERENCE TO RELATED APPLICATIONS

This application claims priority under 35 U.S.C §119(a) Korean Patent Application No. 2007-0012389, filed on Feb. 6, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus that is equipped with a waste toner storage device to collect residual waste toner on an image carrying body after printing an image.

2. Description of the Related Art

A conventional image forming apparatus is an apparatus that prints an image on a printing medium, e.g., paper, according to an input image signal. One type of the image forming apparatus, an electrophotographic image forming apparatus, is configured such that a light beam is scanned to a photosensitive member charged with an electric potential to form an electrostatic latent image thereon. Subsequently, the electrostatic latent image is developed into a toner image by supplying a developer (toner, or toner and carrier) to the electrostatic latent image, and the toner image is transferred and fixed to paper.

The conventional image forming apparatus includes a main body which forms an exterior appearance, a print unit which is mounted inside the main body, a paper supply unit which supplies paper to the print unit, and a paper discharge unit which discharges the printed paper outside of the main body. Referring to a conventional color image forming apparatus, the print unit includes a developing unit which forms yellow, magenta, cyan and black toner images on the respective photosensitive members, a transfer unit which transfers the toner images formed on the photosensitive members onto the paper, and a fixing unit which applies heat and pressure to the paper to fix the toner images to the paper.

The conventional image forming apparatus further includes a cleaning unit which removes waste toner generated by the photosensitive members of the developing unit and the transfer belt of the transfer unit during the repeated printing process, and a waste toner storage device which stores the waste toner collected by the cleaning unit.

Japanese Patent Laid-open Publication No. 2002-229402 discloses a waste toner collecting device of an image forming apparatus. The disclosed conventional waste toner collecting device includes a waste toner container and a vibration device for vibrating the waste toner container. By vibrating the waste toner container using the vibration device, the waste toner accumulates evenly (not in a mountain-shape) in the container. The reason for necessitating the vibration device is that the waste toner contains impurities like fibrous components of paper from the printing process and has low fluidity and high cohesiveness when compared to a new toner. However, the conventional waste toner collecting device has the problem that the size of the device becomes large due to the installation of the vibration device around the waste toner container.

Another exemplary conventional waste toner storage device includes a screw by which the waste toner accumulates evenly in the container. However, if the waste toner accumulates to a certain extent, a borehole is formed around the rotating screw, and the waster toner accumulates in a mountain-shape thereon. Also, the overall capacity of the waste toner storage device decreases from inclusion of the screw.

SUMMARY OF THE INVENTION

The present general inventive concept provides an image forming apparatus that is equipped with a compact waste toner storage device in which a collected waste toner can be evenly stored.

The present general inventive concept also provides an image forming apparatus that is equipped with a waste toner storage device in which a large amount of waste toner can be stored by utilizing a space to the maximum.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including a waste toner storage device which includes a waste toner tank to store waste toner that is collected from a cleaning member to remove the residual waste toner on an image carrying body, and a vibration unit provided inside the waste toner tank to prevent the waste toner from accumulating unevenly.

The vibration unit may include an elastic member which is provided inside the waste toner tank, a drive member to move the elastic member, and a stopper which is protrudingly formed on an inner surface of the waste toner tank on a moving path of the elastic member to apply elastic force to the elastic member.

The elastic member may be a coil spring which is rotatably provided inside the waste toner tank.

The stopper may be provided near an end portion of the coil spring.

The stopper may be provided near a middle portion of the coil spring.

The vibration unit may include a pair of coil springs which are provided inside the waste toner tank, a drive member to helically move the coil springs, and a pair of stoppers which are protrudingly formed on an inner surface of the waste toner tank on helical moving paths of the respective coil springs to apply elastic force to the coil springs. The stoppers may be provided near end portions of the respective coil springs in the opposite direction to each other.

The elastic member may be disposed apart from an inner surface of the waste toner tank in a non-operation state, and if elastic force is applied to the elastic member by the stopper, the elastic member may touch the inner surface of the waste toner tank.

The foregoing and/or other aspects and utilities of the present general inventive concept may also be achieved by providing an image forming apparatus including a main body, a developing unit which is provided inside the main body and forms a toner image on an image carrying body, and a cleaning member which removes residual waste toner on the image carrying body, wherein the developing unit is disposed in the main body, and a waste toner storage device to collect the waste toner is provided from the cleaning member. The waste toner storage device may include a waste toner tank to store the waste toner collected from the cleaning member and a vibration unit provided inside the waste toner tank to prevent the waste toner from accumulating unevenly.

The foregoing and/or other aspects and utilities of the present general inventive concept may also be achieved by providing an image forming apparatus, including a plurality of developing units to form a toner image on a paper, a waste toner tank having a plurality of waste toner inlet holes to receive toner from the plurality of developing units to store the received waste toner from the developing units, and a vibration unit provided inside the waste toner tank to disperse the waste toner inside the waste toner tank.

The plurality of developing units may be disposed in a direction, and the waste toner inlet holes may be arranged in the direction.

The waste toner inlet holes may be spaced-apart from each other to receive the toner from corresponding ones of the developing units.

The vibration unit may be disposed to contact the waste toners received from the developing units.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
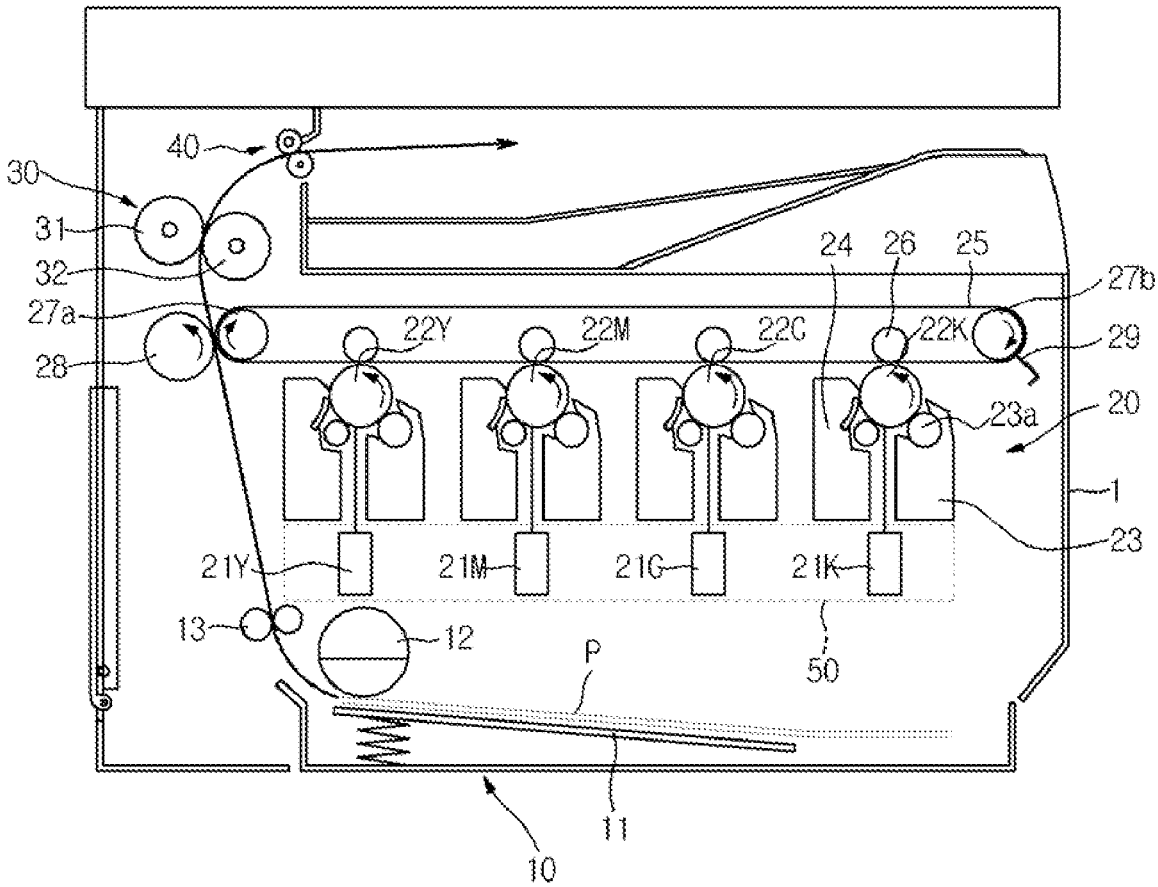
FIG. 1 is a view illustrating schematically an image forming apparatus in accordance with an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

FIG. 1 is a view illustrating schematically an image forming apparatus in accordance with an exemplary embodiment of the present general inventive concept. As illustrated in FIG. 1, the image forming apparatus according to the present general inventive concept includes a main body 1, a paper supply unit 10 to supply a printing medium, e.g., paper P, a developing unit 20 to develop an image on the paper P, a fixing unit 30 to fix the image to the paper P by applying heat and pressure to the paper, and a paper discharge unit 40 to discharge the printed paper outside.

The paper supply unit 10 includes a paper tray 11 on which the paper P is loaded, a pickup roller 12 which picks up the paper P loaded on the paper tray 11 sheet by sheet, and a feed roller 13 which feeds the picked-up paper P toward the developing unit 20.

The developing unit 20 includes a plurality of photosensitive members 22Y, 22M, 22C and 22K (hereinafter, Y, M, C and K will be omitted) on which electrostatic latent images are formed by a plurality of respective exposure units 21, a plurality of toner cartridges 23 in which black, cyan, magenta and yellow toners are respectively stored, a plurality developing rollers 23*a* which receive the toner from the toner cartridges 23 and develop the electrostatic latent images on the photosensitive members 22 into toner images, an intermediate transfer belt 25, a plurality of first transfer rollers 26, and a second transfer roller 28.

Figure 2:
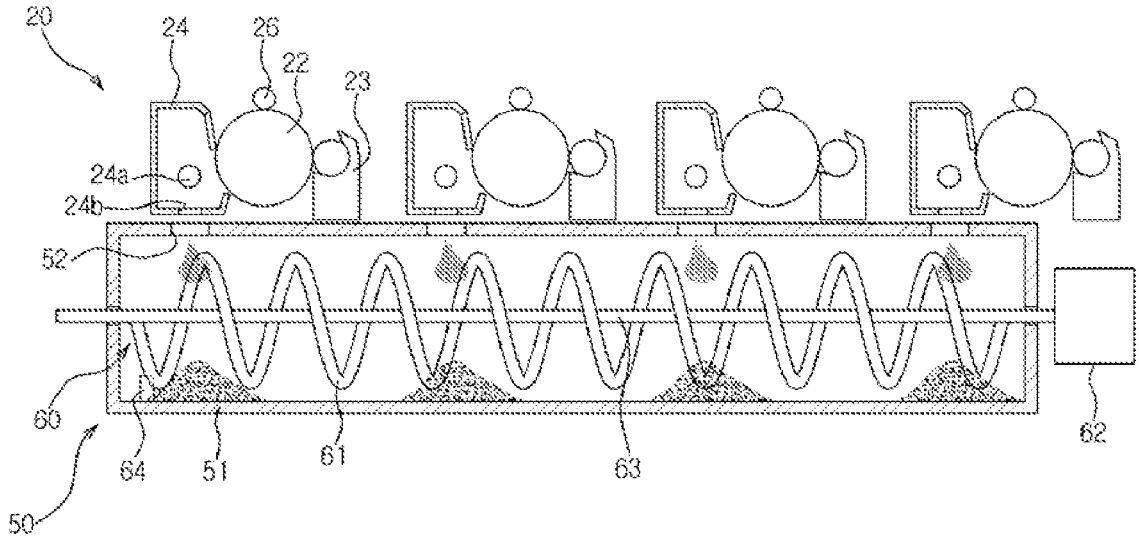
FIG. 2 is a view illustrating a developing unit and a waste toner storage device of the image forming apparatus of FIG. 1.

The photosensitive members 22 are in contact with the developing rollers 23*a* of the toner cartridges 23, the intermediate transfer belt 25, and a plurality of cleaning members 24. The cleaning members 24 remove the residual waste toner remaining on the photosensitive members 22 after the toner images formed on the photosensitive members 22 are transferred onto the intermediate transfer belt 25. Referring to FIGS. 1 and 2, the waste toner drops freely and is collected in a waste toner storage device 50, which is provided below the cleaning members 24, by discharge screws 24*a* provided in the cleaning members 24.

The intermediate transfer belt 25 is supported by supporting rollers the first transfer rollers 26, a driving roller 27*a* and a tension roller 27*b*, and operates at a same velocity as a linear velocity of the rotating photosensitive members 22. The first transfer rollers 26 oppose the respective photosensitive members 22, and transfer toner images developed on the photosensitive members 22 onto the intermediate transfer belt 25. The second transfer roller 28 is disposed opposite to the driving roller 27*a*, which drives the intermediate transfer belt 25. While the toner images are transferred onto the intermediate transfer belt 25 from the photosensitive members 22, the second transfer roller 28 is spaced apart from the intermediate transfer belt 25. When the toner images are completely transferred onto the intermediate transfer belt 25, the second transfer roller 28 comes into contact with the intermediate transfer belt 25 with a predetermined pressure. A blade of a cleaning member 29 is provided near the tension roller 27*b* to support the intermediate transfer belt 25 while contacting the intermediate transfer belt 25 with a prescribed pressure, so as to remove the residual waste toner on the intermediate transfer belt 25 after the transfer operation. The removed waste toner is collected in the waste toner storage device 50 provided below the developing unit 20 through a pipe (not illustrated).

The fixing unit 30 to fix the toner images to the paper P by applying heat and a constant fixing pressure to the paper P includes a heat roller 31 to heat the toner-transferred paper P, and a press roller 32 which is disposed opposite to the heat roller 31 and maintains the constant fixing pressure with the heat roller 31.

The paper discharge unit 40 includes discharge rollers which are sequentially mounted so as to discharge the paper P having passed through the fixing unit 30 to the exterior of the main body.

Figure 3:
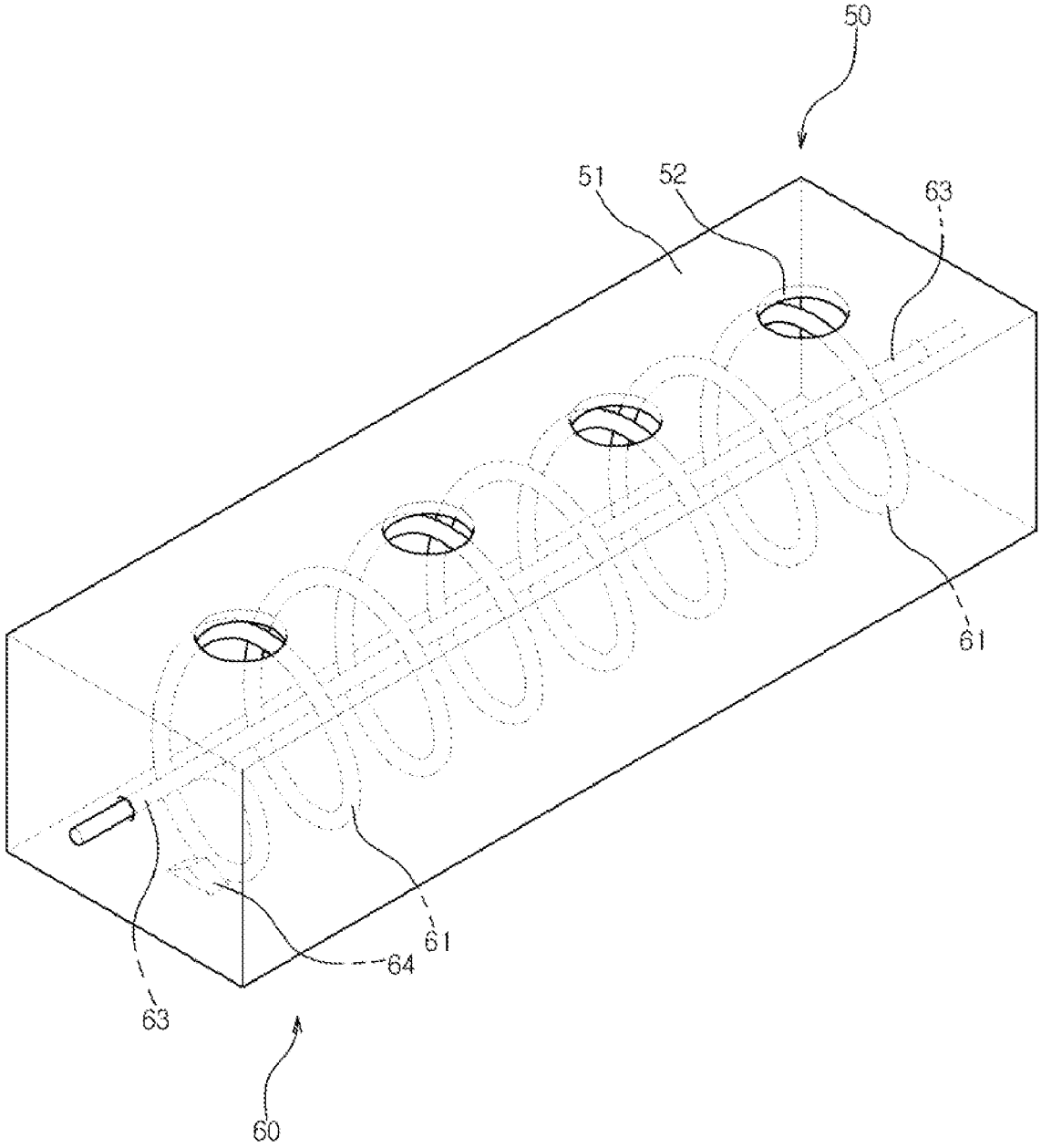
FIG. 3 is a perspective view illustrating the waste toner storage device of FIG. 2.

FIG. 2 is an enlarged view illustrating the developing unit 20 and the waste toner storage device 50 of the image forming apparatus of FIG. 1, and FIG. 3 is a perspective view illustrating the waste toner storage device 50 of FIGS. 1 and 2. As illustrated in FIGS. 2 and 3, the waste toner storage device 50 is provided below the developing unit 20, which is horizontally arranged with respect to the main body 1. In other words, the intermediate transfer belt 25 is provided above the photosensitive members 22, the toner cartridges 23 and the cleaning members 24 are disposed on the left and right sides of the respective photosensitive members 22, and the waste toner storage device 50 is provided in a lengthwise direction below the developing unit 20 so as to collect the waste toner which drops freely from the cleaning members 24.

As illustrated in FIG. 2, the waste toner storage device 50 includes a waste toner tank 51 to store the waste toner. A plurality of waste toner inlet holes 52 (i.e., the embodiment of FIG. 2 includes four waste toner inlet holes 52) are formed at a top of the waste toner tank 51, corresponding to waste toner discharge holes 24*b* of the respective cleaning members 24. An additional waste toner inlet hole (not illustrated) may be formed at the waste toner tank 51, through which the waste toner from the cleaning member 29 of the intermediate transfer belt 25 is collected in the waste toner tank 51. The additional waste toner inlet hole may be formed between the adjacent waste toner inlet holes 52 to receive the waste toner through a portion between the developing units 20 from the intermediate transfer belt 25. A vibration unit 60 is mounted inside the waste toner tank 51 to prevent the waste toner from accumulating in a mountain-shape near the waste toner inlet holes 52.

The vibration unit 60 includes an elastic member 61 which is provided inside the waste toner tank 51, a drive member 62 which moves the elastic member 61, and a stopper 64 which is provided on the moving path of the elastic member 61 and applies elastic force to the elastic member 61.

According to the embodiment of FIG. 2, the elastic member 61 may be configured as a coil spring which is rotatably provided inside the waste toner tank 51, and the drive member 62 may be configured as a typical gear box which is provided outside the waste toner tank 51 to rotate the coil spring 61. The drive member 62 may be connected to a drive source (not illustrated) in the main body 1.

Both ends of the coil spring 61 are fixed to a rotating shaft 63, which is provided across the waste toner tank 51. The coil spring 61 may have a predetermined diameter and both end portions fixed to the rotating shaft 63 have a semicircular cam shape extending from the rotating shaft 63 and the remaining portion has a circular shape.

The stopper 64 is protrudingly formed on an inner surface of the waste toner tank 51. The stopper 64 may be positioned on a helical movement path of the coil spring 61 to apply elastic force to the coil spring 61. The stopper 64 hinders the helical movement of the coil spring 61 to generate an elastic deformation of the coil spring 61. When the coil spring 61 further moves helically and escapes from the stopper 64, the coil spring 61 vibrates due to the elastic deformation.

If the stopper 64 is formed near an end portion of the coil spring 61, the vibration in a longitudinal direction of the coil spring 61 may be generated. If the stopper 64 is formed near a middle portion of the coil spring 61, the vibration is generated in a transverse direction of the coil spring 61.

Also, the coil spring 61 is disposed at a gap from the inner surface of the waste toner tank 51 to vibrate from itself. If the gap between the coil spring 61 and the waste toner tank 51 is adjusted so that the coil spring 61 touches the inner surface of the waste toner tank 51 when vibrating, cohesion of the waste toner adhering to the waste toner tank 51 is prevented, so that the waste toner accumulates evenly on the bottom of the waste toner tank 51.

Hereinafter, the operation of the image forming apparatus according to an embodiment of the present general inventive concept structured as above will be described.

If a print command is input, a light beam corresponding to color image information is scanned to the photosensitive members 22 charged with a uniform electric potential by the charge rollers, and the color toner images corresponding to the images of respective colors are formed on the photosensitive members 22. The color toner images are transferred onto the intermediate transfer belt 25 by the first transfer rollers 26, and the color toner images on the intermediate transfer belt 25 are transferred onto the paper P passing between the second transfer roller 28 and the intermediate transfer belt 25. The images transferred onto the paper are fixed to the paper while passing through the fixing unit 30, and the paper passed through the fixing unit 30 is discharged outside through the paper discharge unit 40.

Figure 4:
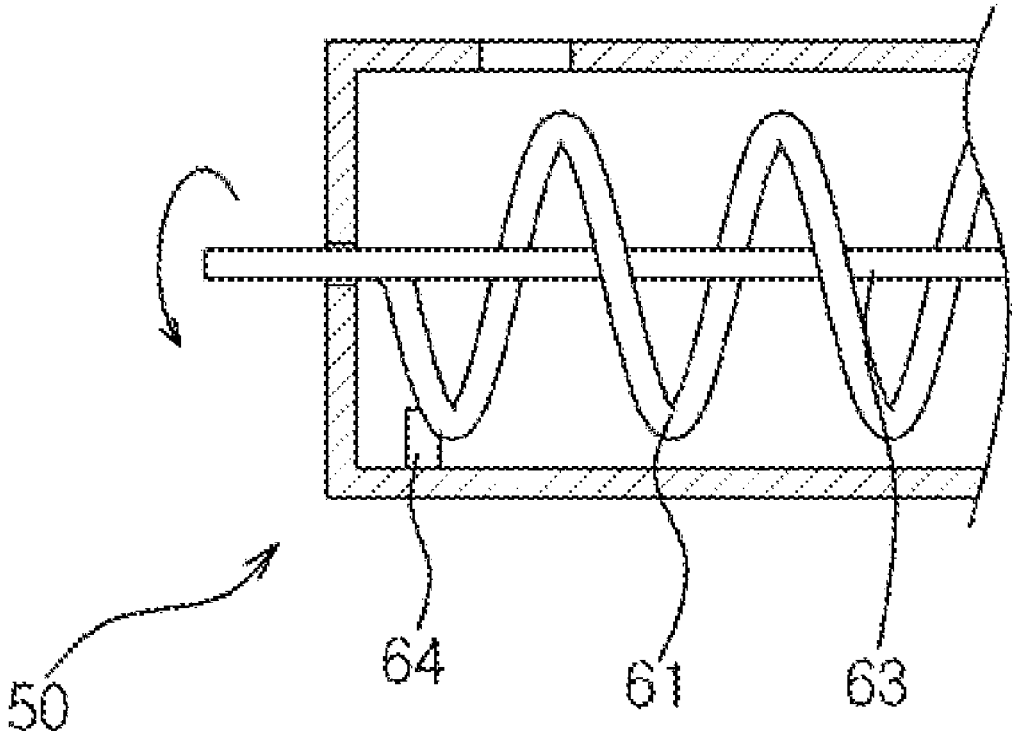
FIGS. 4 through 6 are sectional views illustrating the operation of the waste toner storage device of the image forming apparatus of FIGS. 1, 2, and 3.

During the printing process, the residual waste toner on the image carrying body (photosensitive members 22 and the intermediate transfer belt 25) after forming the toner images is removed by the cleaning members 24 and 29 and collected in the waste toner storage device 50. When the waste toner is collected to a certain extent in the waste toner storage device 50, drive power is applied to the gear box 62 connected to the drive source in the main body 1 to rotate the coil spring 61 in the waste toner tank 51, as illustrated in FIG. 4.

Figure 5:
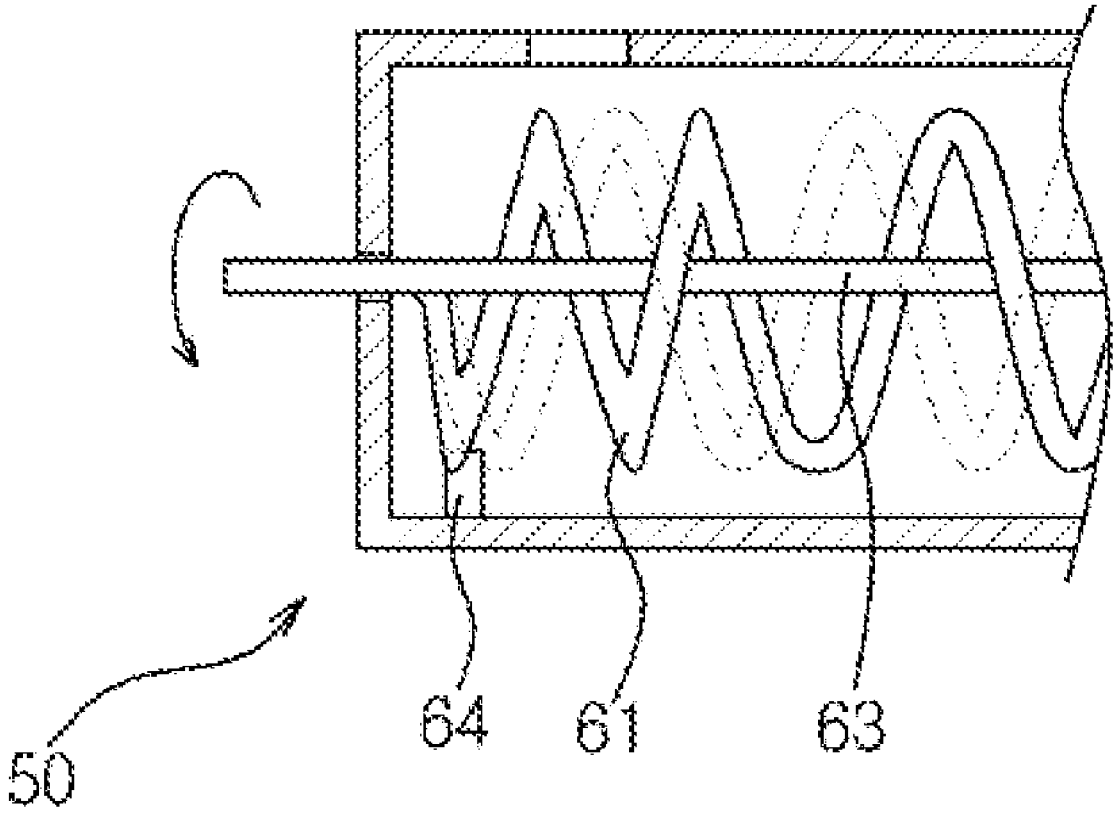
Figure 6:
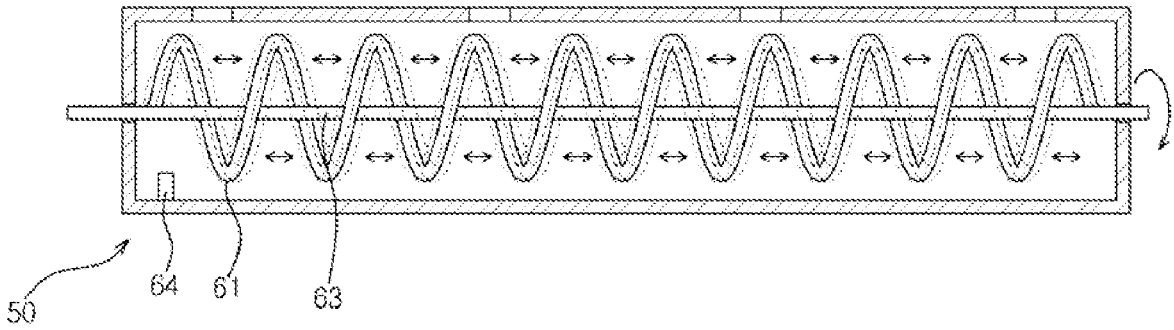

As illustrated in FIG. 5, when the coil spring 61 rotates, the coil spring 61 is caught by the stopper 64 formed near the end of the coil spring 61 and begins deforming elastically. The elastically-deformed coil spring 61 escapes from the stopper 64 at a certain moment by the rotational force steadily exerted to the coil spring 61, and as illustrated in FIG. 6, the coil spring 61 vibrates by the elastic force. By the vibration of the coil spring 61, the waste toner accumulating in a mountain-shape near the waste toner inlet holes 52 spreads in various directions and accumulates evenly in the waste toner tank 51. If the coil spring 61 is designed to touch the inner surface of the waste toner tank 51 when vibrating, the waste toner which is adhered to the inner surface of the waste toner tank 51 is taken off the inner surface and thus the waste toner accumulates more evenly in the waste toner tank 51.

Figure 7:
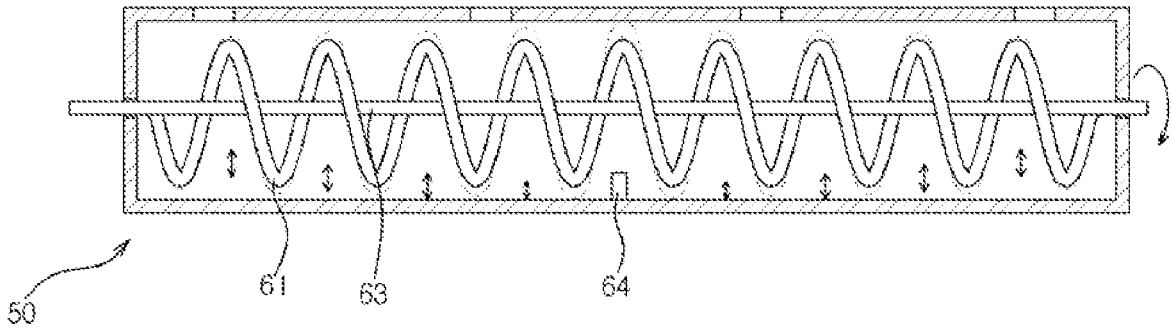
FIG. 7 is a sectional view illustrating the operation of a waste toner storage device of an image forming apparatus of FIG. 1.

Meanwhile, as illustrated in FIG. 7, if the stopper 64 is formed near a middle portion of the coil spring 61, the vibration in a transverse direction of the coil spring 61 is primarily generated rather than the vibration in a longitudinal direction (i.e., as in FIG. 6) so that the waste toner accumulates evenly in the waste toner tank 51.

Figure 8:
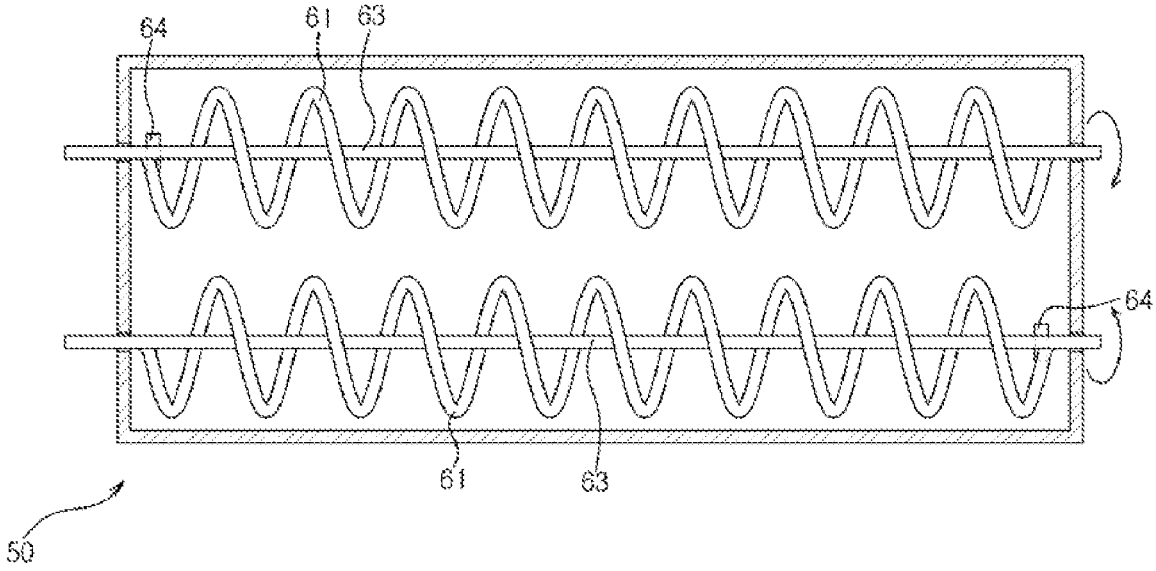
FIG. 8 is a plan view illustrating a waste toner storage device of an image forming apparatus of FIG. 1.

Also, as illustrated in FIG. 8, the present general inventive concept may be modified such that a pair of coil springs 61 are provided inside the waste toner tank 51 and a pair of stoppers 64 are formed near the end portions of the respective coil springs 61 at opposite ends.

It has been explained in the above description that the coil spring 61 is mounted to the rotating shaft 63, however, the present general inventive concept is not restricted thereto. For example, if the coil spring 61 having sufficient rigidity is used, the coil spring 61 can be mounted inside the waste toner tank and connected to the drive member 62 without the rotating shaft 63.

As apparent from the above description, an image forming apparatus according to an embodiment of the present general inventive concept is formed such that a vibration unit to make the waste toner accumulate evenly in the waste toner tank is provided inside the waste toner tank. Accordingly, the apparatus can be manufactured compactly.

Also, because a coil spring and a stopper are used in the vibration unit, the vibration unit does not take up much space in the waste toner tank. Further, much more waste toner can be stored in the waste toner tank, despite having a same size as a conventional waste toner tank.

Although embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a waste toner storage device comprising:

a waste toner tank to store waste toner collected from a cleaning member to remove the residual waste toner on an image carrying body; and a vibration unit provided inside the waste toner tank to prevent the waste toner from accumulating unevenly, and including a stopper to induce a vibration of the vibration unit.

2. The image forming apparatus according to claim 1, wherein the vibration unit comprises:

an elastic member provided inside the waste toner tank; and a drive member to move the elastic member.

3. The image forming apparatus according to claim 2, wherein the stopper is protrudingly formed on an inner surface of the waste toner tank on a moving path of the elastic member to apply elastic force to the elastic member.

4. The image forming apparatus according to claim 2, wherein the elastic member is a coil spring rotatably provided inside the waste toner tank.

5. The image forming apparatus according to claim 4, wherein the stopper is provided near a middle portion of the coil spring.

6. The image forming apparatus according to claim 4, wherein the stopper is provided near an end portion of the coil spring.

7. The image forming apparatus according to claim 4, wherein:

the coil spring and the stopper are provided in plurality; and the stoppers are provided near end portions of the respective coil springs at opposite ends of the respective coil springs.

8. The image forming apparatus according to claim 2, wherein:

the elastic member is disposed apart from an inner surface of the waste toner tank in a non-operation state; and if elastic force is applied to the elastic member by the stopper, the elastic member touches the inner surface of the waste toner tank.

9. An image forming apparatus, comprising:

a main body;

a developing unit provided inside the main body to form a toner image on an image carrying body;

a cleaning member to remove residual waste toner on the image carrying body; and a waste toner storage device to collect the waste toner provided from the cleaning member, comprising:

a waste toner tank to store the waste toner collected from the cleaning member, and a vibration unit to prevent the waste toner from cumulating unevenly and including a stopper to induce a vibration of the vibration unit.

10. The image forming apparatus according to claim 9, wherein:

the developing unit is disposed in a horizontal direction in the main body; and the waste toner storage device to collect the waste toner is provided below the cleaning member.

11. The image forming apparatus according to claim 9, wherein the vibration unit comprises:

an elastic member provided inside the waste toner tank; and a drive member to move the elastic member.

12. The image forming apparatus according to claim 11, wherein the stopper is protrudingly formed on an inner surface of the waste toner tank on a moving path of the elastic member to apply elastic force to the elastic member.

13. The image forming apparatus according to claim 12, wherein the elastic member is a coil spring rotatably provided inside the waste toner tank.

14. The image forming apparatus according to claim 13, wherein the stopper is provided near a middle portion of the coil spring.

15. The image forming apparatus according to claim 14, wherein:

the coil spring and the stopper are provided in plurality; and the stoppers are provided near end portions of the respective coil springs at opposite ends.

16. The image forming apparatus according to claim 12, wherein:

the elastic member is disposed apart from an inner surface of the waste toner tank in a non-operation state; and if elastic force is applied to the elastic member by the stopper, the elastic member touches the inner surface of the waste toner tank.

17. An image forming apparatus, comprising;

a plurality of developing units to form a toner image on a paper;

a waste toner tank having a plurality of waste toner inlet holes to receive toner from the plurality of developing units to store the received waste toner from the developing units; and a vibration unit provided inside the waste toner tank to disperse the waste toner inside the waste toner tank, and including a stopper to induce a vibration of the vibration unit.

18. The image forming apparatus of claim 17, wherein:

the plurality of developing units are disposed in a direction; and the waste toner inlet holes are arranged in the direction.

19. The image forming apparatus of claim 17, wherein the waste toner inlet holes are spaced-apart from each other to receive the toner from corresponding ones of the developing units.

20. The image forming apparatus of claim 17, wherein the vibration unit is disposed to contact the waste toners received from the developing units.

* * * * *